US005639029A

United States Patent [19]

Sundholm

[11] Patent Number: 5,639,029

[45] Date of Patent: Jun. 17, 1997

[54] NOZZLE WITH HELICAL SPRING WHICH SETS LIQUID IN WHIRLING MOTION

[76] Inventor: Göran Sundholm, Ilmari Kiannon kuja 3, FIN-04310 Tuusula, Finland

[21] Appl. No.: 403,683

[22] PCT Filed: Sep. 14, 1993

[86] PCT No.: PCT/FI93/00365

§ 371 Date: Apr. 18, 1995

§ 102(e) Date: Apr. 18, 1995

[87] PCT Pub. No.: WO94/06567

PCT Pub. Date: Mar. 31, 1994

[30] Foreign Application Priority Data

| | | | |
|---|---|---|---|
| Sep. 15, 1992 | [FI] | Finland | 924119 |
| Sep. 15, 1992 | [FI] | Finland | 924120 |
| Sep. 3, 1993 | [FI] | Finland | 933873 |

[51] Int. Cl.[6] ..... B05B 1/34; A62C 31/02

[52] U.S. Cl. ..... 239/488; 239/491; 239/570

[58] Field of Search ..... 239/457, 488, 239/570, 491

[56] References Cited

U.S. PATENT DOCUMENTS

| | | | |
|---|---|---|---|
| 551,875 | 12/1895 | Schuffe | 239/488 |
| 887,302 | 5/1908 | Barnes | 239/488 X |
| 2,017,467 | 10/1935 | Loomis | 239/488 X |
| 2,329,711 | 9/1943 | Gilsenaj | 239/488 X |
| 2,407,915 | 9/1946 | Ball | 299/107.6 |
| 2,560,799 | 7/1951 | Johnson | 299/107.6 |
| 3,684,019 | 8/1972 | Emmons et al. | 169/1 A |
| 4,655,394 | 4/1987 | Ferrazza | 239/412 |

FOREIGN PATENT DOCUMENTS

| | | | |
|---|---|---|---|
| 81700 | 6/1915 | Germany | 239/488 |
| 2311427 | 9/1974 | Germany . | |
| 435990 | 11/1967 | Switzerland . | |
| 770554 | 6/1978 | U.S.S.R. . | |
| 641089 | 8/1950 | United Kingdom | 239/488 |
| 9220453 | 11/1992 | WIPO . | |
| 9220454 | 11/1992 | WIPO . | |

*Primary Examiner*—Kevin Weldon
*Attorney, Agent, or Firm*—Ladas & Parry

[57] ABSTRACT

A nozzle for a spray head has a housing having an orifice. A helical spring in the housing extends toward the orifice for liquid in the housing to flow in a helical path between loops of the spring in a strong whirling motion before being discharged through the orifice. A spindle element is in an at least essentially cylindrical passage in the housing with the helical spring, the helical spring extending around the spindle element and engaging at one end the housing at the orifice and at an opposite end the spindle element for a force of the helical spring to urge the spindle element away from the orifice towards a stop in the cylindrical passage, the spindle element being axially movable in an axial direction of the cylindrical passage in response to the force and an opposite-acting pressure force of the liquid.

13 Claims, 3 Drawing Sheets

NOZZLE WITH HELICAL SPRING WHICH SETS LIQUID IN WHIRLING MOTION

The present invention relates to a nozzle.

The object of the invention is to provide a new nozzle which in particular is suitable for use in such spray heads which are capable of operating at a high driving liquid pressure.

The nozzle according to the invention is mainly characterized by a helical spring arranged before the orifice of the nozzle in such a way that liquid is made to flow in a helical path between the loops of the spring, in order to set the liquid in a strong whirling motion before being discharged through the orifice.

Preferably the helical spring is positioned around a spindle element insertable into an at least essentially cylindrical passage in the housing of the nozzle.

As the operating pressure decreases, the spring expands gradually, whereat the pin follows along and is removed from its bottom position near the orifice of the nozzle. This results in a decreasing flow resistance before the nozzle orifice, partly because the distance increases between adjacent loops of the helical spring and the cross section of the helical flow path thus increases, and partly because the axial length of the helical path becomes shorter.

Thus the amount of discharged liquid per time unit will remain essentially constant in spite of variations in the operating pressure. In many cases it is of advantage to employ one or several hydraulic accumulators as drive unit for the liquid, whereat an essentially constant rate of liquid spray can be obtained in spite of a decreasing operating pressure as the hydraulic accumulators gradually are discharged.

In the following the invention shall be described in more detail with reference to the attached drawing which, by way of example, show a number of preferred embodiments.

Figure 1:
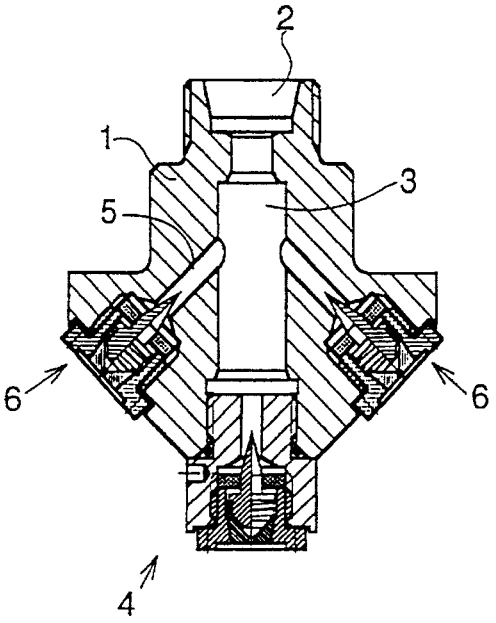
FIG. 1 shows an axial section of a spray head with a first embodiment of nozzles according to the present invention.

In the drawing the reference numeral 1 indicates a housing of a spray head with an inlet 2 for liquid, preferably of a high pressure, even up to about 300 bar. The inlet 2 continues as an axial channel 3 which in FIG. 1 leads to a centrally arranged nozzle 4 and from which lead branch channels 5 to side nozzles 6 directed obliquely outwards. The central nozzle 4 and the side nozzles 6 in FIG. 1 are a first preferred embodiment of the invention and shall in the following be described in more detail with reference to FIGS. 2, 3 and 4 which show a side nozzle 6.

The nozzle 6 has a body or holder 7 which by means of a thread 8 is screwed in a seat joining a branch channel 5 in the housing 1 of the spray head. Through the holder 7 runs a connection which, seen in the direction from the channel 5, has a cylindrical portion the wall of which is indicated by 9 and which ends at an annular stop 10, and a conically narrowing portion with a whirl chamber element 11 which defines a conically narrowing whirl chamber 12 and an orifice 13.

Between the inner en of the holder 7 and a stop 14 formed in the nozzle seat is arranged a filter, preferably a disc-like sintered metal filter 15 having a central opening through which is entered an end pin 16 of a spindle having a cylindrical portion 17 reaching into the cylindrical passage of the holder 7 and terminating in an end surface 18 matching the conical surface of the whirl chamber 12 and provided with e.g. two to four oblique grooves 19.

Around cylindrical portion 17 of the spindle is laid a helical spring 20 with one end bearing against the stop 10 and/or the inner end of the whirl chamber element 11 or the wall of the whirl chamber 12 and the other end bearing against a flange 21 of the spindle said flange 21 in turn bearing against the filter 15. The spring 20 thus tends to press the spindle away from the whirl chamber 12 and to press the filter 15 against the stop 14. The diameter of the flange 21 is a little smaller than the diameter of the cylindrical passage, at 9, of the holder 7, so that there is an annular passage 22 between the flange 21 and the wall 9, when the spindle is driven against the (bottom) wall of the whirl chamber 12, as shown in FIG. 3.

Along the annular space between the cylindrical spindle portion 17 and the wall 9 of the cylindrical passage is formed a helical path 23 along and between the loops of the spring 20; the spindle portion 17 and the spring 20 are preferably of such dimensions that practically all of the passing liquid follows the helical path 23, and thereby the liquid is given a strong whirling motion in the whirl chamber 12 and further out through the orifice 13.

Figure 2:
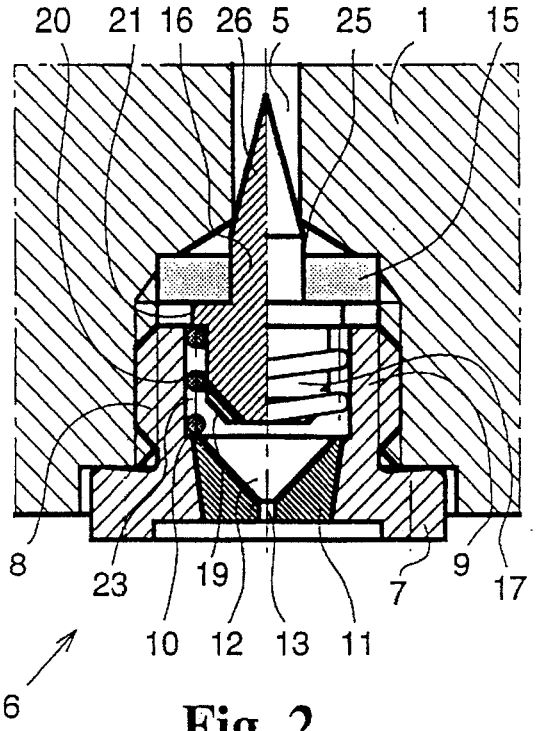
FIGS. 2, 3 and 4 show in an enlargened scale an axial section of an individual nozzle of FIG. 1, under the influence of different liquid pressures.

In FIG. 2 the spray head is either inactive or the active liquid pressure is so low that the spring 20 forces the filter 15 into abutment against the stop 14. The spring 20 is relatively expanded and the cross section of the helical path 23 is relatively wide. There is a gap 24 between the filter 15 and the end of the holder 7. A preferably conical extension 26 of the pin element 16 reaches into the inlet channel 5 and closes the orifice of the channel 5. That surface of the flange 21, against which the spring 20 bears, is essentially level with the inner end of the holder 7.

Figure 3:
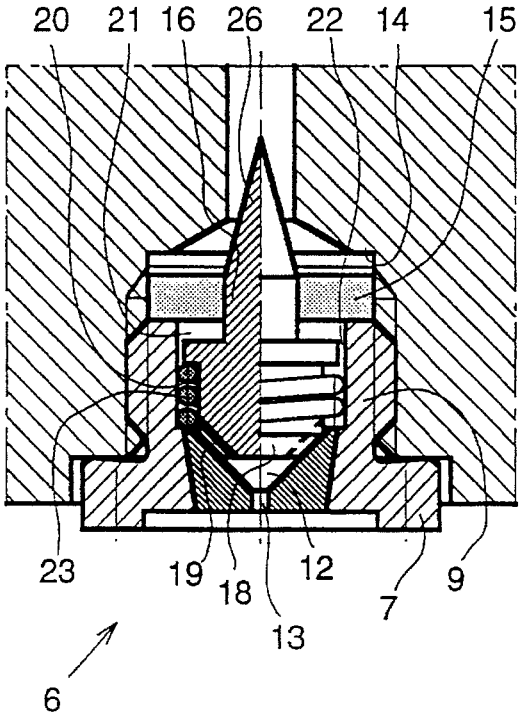

In FIG. 3 the spray head is activated and the liquid pressure is high. The pressure fall especially over the annular gap 27 between the cone 26 and the surrounding edge of the orifice of the inlet channel 5 and over the annular passage 22 .between the flange 21 and the holder wall 9, and to some extent also over the filter 15 and the helical path 23, is so great that the spring 20 is compressed until the filter 15 hits the holder 7, and thereafter the spindle continues the movement on its own, because of the pressure fall over the annular passages 27 and 22. The end surface 18 of the spindle reaches down into contact with the whirl chamber bottom wall and thus the helical path 23 is much narrower than in FIG. 2. A violently whirling fog-like liquid spray is discharged through the orifice 13.

For spray heads contemplated in the present patent application it is often convenient to utilize one or a plurality of hydraulic accumulators as a drive unit and a source of liquid.

The driving gas pressure, and thus the liquid pressure, will gradually fall to a value so low that the spring 20 forces the spindle loose from the whirl chamber element 11. The pressure falls especially over the annular passage 22 and over the annular gap 27 now balance the spring 20. As the drive pressure continues to fall, the spring 20 expands further until the conical extension eventually blocks the inlet channel 5, whereat the filter 15 is close at or against the stop 14.

Figure 4:
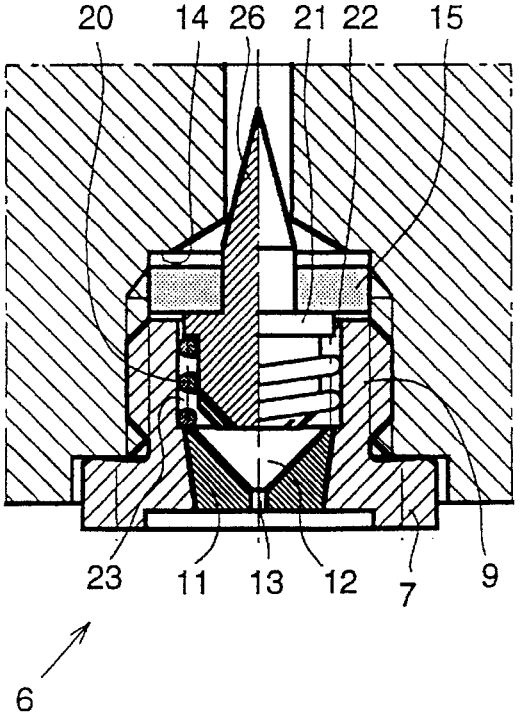
Figure 5:
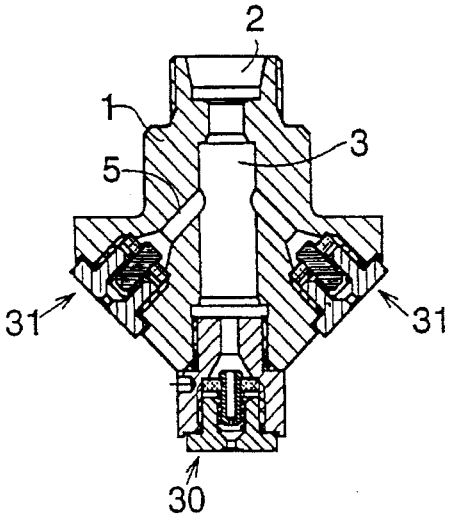
FIG. 5 shows an axial section of a spray head with a second embodiment of nozzles according to the present invention.
Figure 6:
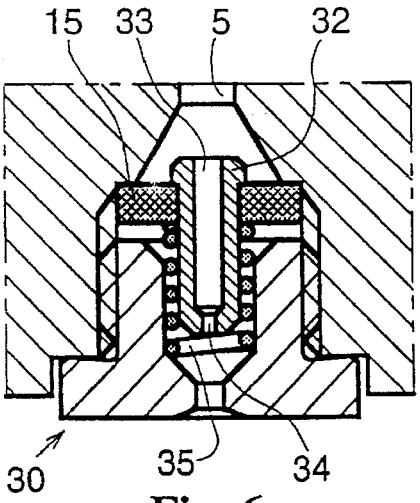
FIGS. 6 and 7 show in an enlargened scale an axial section of the central nozzle of FIG. 5, under the influence of two different liquid pressures.
Figure 7:
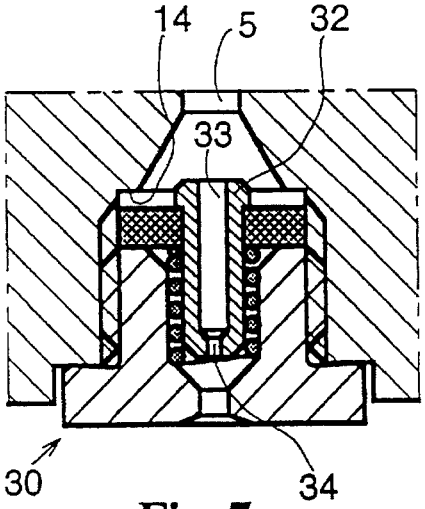
Figure 8:
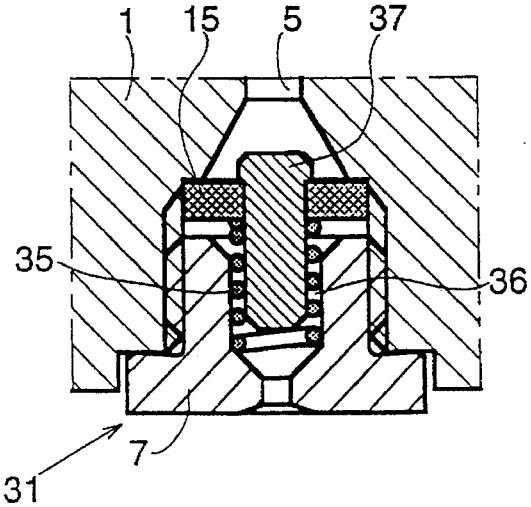
FIGS. 8 and 9 show in an enlargened scale an axial section of the side nozzles of FIG. 5, under the influence of two different liquid pressures.
Figure 9:
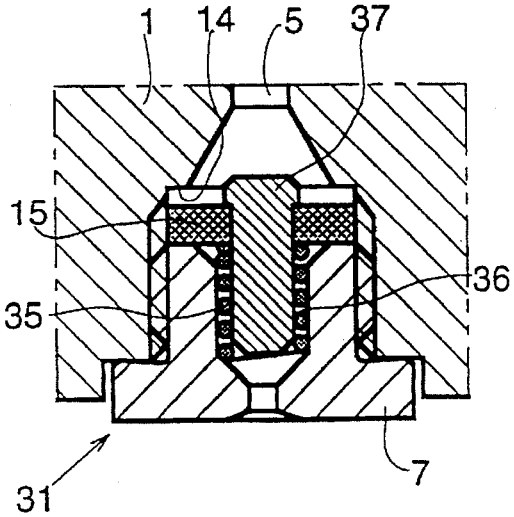

In the state of FIG. 4, a desired centered positioning of the spindle is, in spite of the lateral, or radial clearance between the filter 15 and the stop 14 and the clearance 25 between the pin element 16 and the filter 15, ensured by means of the conical extension 26 of the pin element 16. A centered position is desirable in order to obtain an even width for the annular passages 22 and 27 all around and thus to obtain an essentially predeterminable flow resistance through these passages. The liquid flow past the cone 26 automatically centers the spindle structure. It should be noted, however, that a satisfactory result can be achieved in many cases also without an extension 26, i.e. with the pin element ending at or slightly above the filter 15, e.g. as the pin element 32 in FIGS. 5–7.

By varying the axial length of the cylindrical pin element 16 and/or the tapering angle of the extension 26 it is possible to close the inlet 5 at a predeterminable liquid pressure as the spring 20 with decreasing drive pressure gradually expands from the state of FIG. 3 through the state of FIG. 4 back to the state of FIG. 2. In the embodiment of FIGS. 1–4 the extension 26 closes the inlet 5 just before or just as the filter 15 contacts the stop 14. The extension 26 may of course alternatively have the general form of a truncated cone. If the grooves 19 are omitted, the nozzle will be closed in the position of FIG. 3 and will open at a predeterminable decreased pressure. The filter 15 plays only a minor, deletable part in creating those pressure falls which govern the function of the nozzle, but a filter is recommendable for cleaning the liquid.

In the state of FIG. 4 the cross section of the helical path 23 is wider than in FIG. 3. The result of this is that the rate of liquid out of the orifice does not decrease in proportion to the decreasing liquid pressure but remains at a surprisingly constant rate, although the whirling motion of the liquid fog successively decreases and the droplet size increases.

The force of the spring 20, as well as the annular passages 22 and 27, can be varied according to varying considerations with respect to liquid rate, droplet sizes, desired drive pressures etc., at different stages of a fire extinguishing procedure. Different spray heads in an installation for fighting fire may be individually adapted, likewise individual nozzles in one spray head.

In the latter case it is primarily the central nozzle of a spray head, as in FIG. 1, that can be adapted to differ from the side nozzles, e.g. in such a way that the spring is somewhat stronger than the springs of the side nozzles, whereby it at a decreased liquid pressure is possible to for a longer time maintain a relatively forceful liquid spray or jet in the main direction. This can be utilized e.g in a portable pistol-like fire extinguisher device as shown in the Finnish patent application No. 924119 in such a way that simultaneously with a forceful liquid jet in the main direction, through a central nozzle, a shield of liquid fog is provided by means of the side nozzles, whereby it is possible to approach close to a violent fire developing intensive heat. Such a manually maneuvrable device can without difficulties be constructed in such a way that the operating or liquid pressure can be varied as desired during the extinguishing procedure.

By means of nozzles according to the invention a particularly favourable effect is achieved when hydraulic accumulators according to the Finnish patent application No. 924752 are used as a drive unit. Such hydraulic accumulators have an outlet tube with wall apertures, so that drive gas is mixed into the extinguishing liquid after the gas pressure has decreased to a predeterminable level. In the initial stage according to FIG. 3 a violently whirling liquid fog with small droplets and a good penetration power is achieved, in the beginning of the stage according to FIG. 4 larger droplets with a good capability of cooling hot surfaces and smouldering fires is achieved, and thereafter, with gradually decreasing drive pressure and increasing amounts of intermixed gas, and gradual return to the state of FIG. 2, a total flooding with even smaller droplets than during the initial stage of FIG. 3 can be maintained for a long time.

In fire fighting installations employing a liquid pump as a drive unit, the nozzles according to the invention makes it possible to vary the mode of liquid spray during the extinguishing procedure, by varying the operating pressure of the liquid pump, or by arranging valves for throttling the liquid flow and thereby adjusting the pressure. The action range for each spray head can therefore be expanded and one can manage with fewer spray heads.

The embodiment shown in FIGS. 5–9, with a central nozzle 30 and side nozzles 31, has in the central nozzle a spindle pin 32 with an axial channel 33 ending in a throttle 34. A helical spring 35 is laid around the pin 32 to form a helical flow path 36 along and between the loops of the spring 35. This embodiment produces in general a rather forceful spray that creates a suction which brings along liquid fog produced by the side nozzles 31, which can have a solid spindle pin 37 with a helical spring 35 around it to form a helical flow path 36. The pin 37 preferably has an expanded head portion 38 in order to form an annular passage 39 between the head 38 and the surrounding wall of the housing 1, for the same purpose as the extension 26 shown in FIGS. 1–4. The head 38 may be formed to block the inlet 5 in the position of FIG. 8.

FIGS. 6 and 7, and 8 and 9, show, like FIGS. 2 and 3, the situation at no or low liquid pressure and at a high liquid pressure, respectively. Naturally the situation of FIG. 4 occurs as well.

A further embodiment of the invention is shown in FIGS. 10–14. The side nozzles 6 of the spray head are of the same kind as in FIGS. 1–4 and the central nozzle 60 has a holder 61 screwed into the lower end of the central channel 3 of the spray head and with a whirl chamber 62 at the nozzle orifice. A helical spring 63 is at its one end supported against the wall of the whirl chamber 62 and at its other end against a thickened plunger-like portion of a spindle 64 movable in the central channel 3, said plunger-like portion forming approximately that half of the spindle which is towards the inlet of the channel 3. Between the plunger portion of the spindle 64 and the wall of the channel 3 there is an annular passage 71. Through the spindle 64 runs an axial channel 65 with a throttle 46 at its inlet and with branchings 67 to the channel 3 after the plunger portion of the spindle. The thinner portion 69 of the spindle 64, around which portion 69 the spring 63 is laid, can for the rest be massive. The loops of the spring 63 form a helical path 70 between the spindle portion 69 and the cylindrical portion of the holder 61 screwed into the end of the channel 3.

Figure 10:
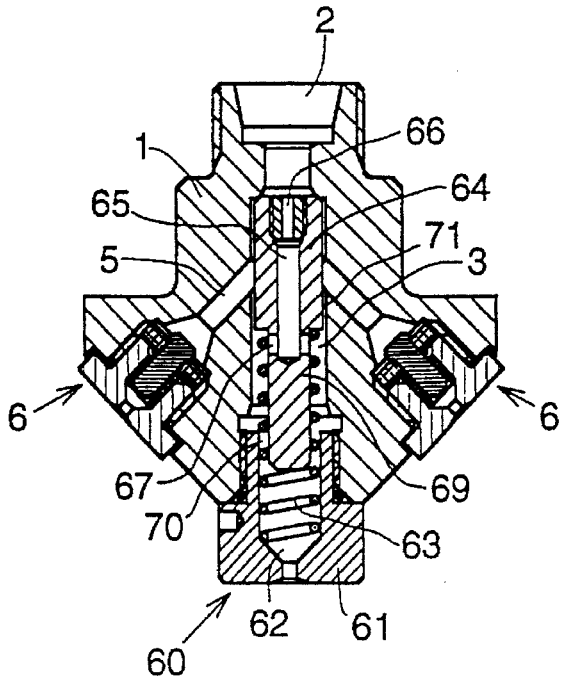
FIGS. 10–14 show an alternative nozzle embodiment applied on a nozzle centrally arranged in the spray head, under the influence of different liquid pressures.
Figure 11:
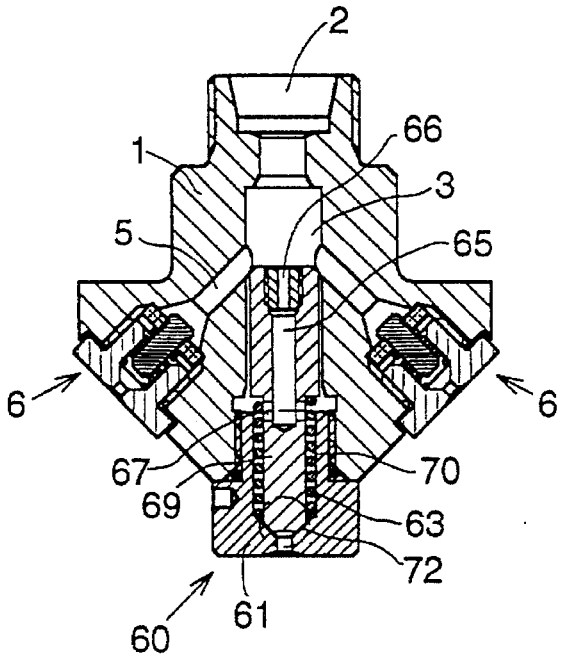

In inactive state, as shown in FIG. 10, the spring 63 forces the spindle 64 to abutment against the inlet of the central channel 3. A high pressure liquid flowing through causes such a pressure drop over the throttle 66 and over the annular passage 71 between the plunger portion of the spindle 64 and the wall of the channel 3 that the spindle is driven to the bottom towards the central nozzle 60, as shown in FIG. 11, with the massive spindle portion 69 in abutment with its preferably conical end against the likewise conical wall of the whirl chamber 62. The spring 63 is compressed and the helical path 70 formed by the loops of the spring is narrow and continues after the end of the spring 63 in a passage 72 formed between the spindle end and the wall of the whirl chamber and leading to the nozzle orifice.

Figure 12:
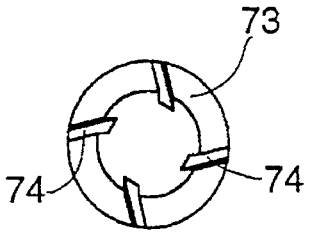
Figure 13:
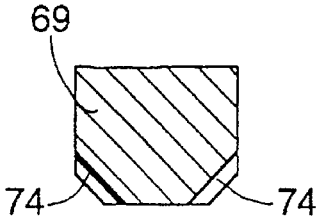

A preferable embodiment of the passage 72, which is not clearly visible in FIG. 11, is shown in FIGS. 12 and 13. The conical end surface of the spindle portion 69 is indicated by 73 and a number of preferably oblique grooves, e.g. two to four grooves, in the conical surface 73 are indicated by 74. In the position of FIG. 12 the central nozzle 60 thus produces a violently whirling liquid fog, just as the side nozzles 6. The grooves 19 in the embodiment of FIGS. 1–4 are preferably arranged in the same way. If the grooves 74 are omitted, that particular nozzle will be closed in the position of FIG. 11.

Figure 14:
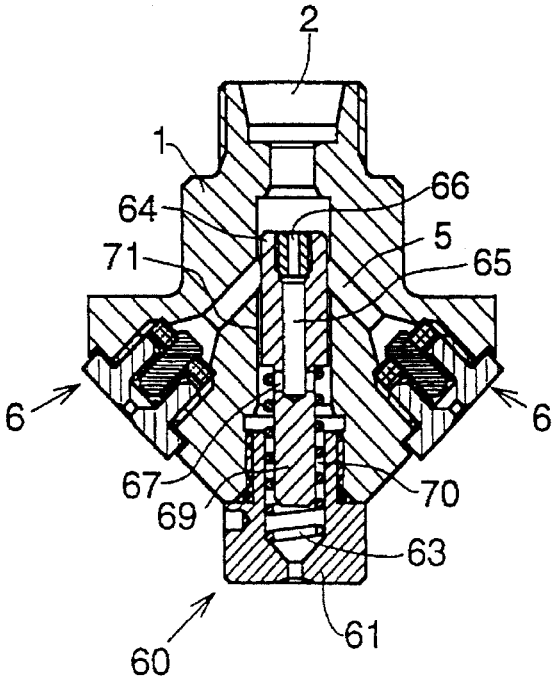

After the liquid pressure has decreased sufficiently, the spindle 64 takes a position approximately as in FIG. 14. In this position the pressure drop over the annular passage 71, the throttle 66 and the helical path 70 balances the force of the spring 63. The helical path 70 is now wider as in FIG. 12, and the feed channels 5 to the side nozzles 6 are essentially blocked by the plunger portion of the spindle 64. Most of the liquid is now discharged through the central nozzle 60 as a forceful concentrated spray.

An effective pressure fall in the state of FIG. 14 can alternatively be brought about by means of the annular passage 71 alone, i.e. with the throttle 66 blocked. The annular passage 71 would then be wider and would permit a correspondingly freer connection to the side nozzles in FIG. 14.

In general the embodiment of FIGS. 10–14 provides for a wide variation range with respect to droplet sizes through the central nozzle 60, because the movement of the spring 63 is proportionally long with a correspondingly wide cariation of the cross section of the helical path 70. Consequently, the action range of the central liquid jet is long in the FIG. 14 position.

Figure 15:
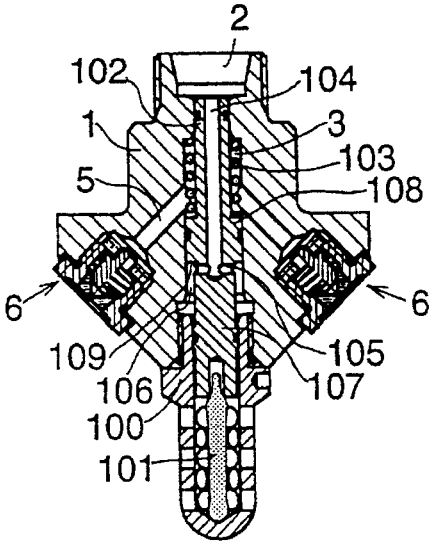
FIG. 15 shows nozzles according to FIGS. 1–4 mounted in a spray head provided with a release ampoule.

FIG. 15 shows a spray head with a number of side nozzles of the same kind as in FIGS. 1–4. In the position of the earlier described central nozzles there is arranged a holder 100 for a release ampoule 101 which melts or breaks at a certain risen temperature. A spindle 102 positioned in the central channel 3 of the spray head is arranged to be forced by a helical spring 103 against the ampuole 101 with a force which alone is not capable of breaking the ampoule but which after the ampoule has melt or broken drives the spindle 102 downwards from the position of FIG. 15 and thereby opens liquid connections from the spray head inlet to the side nozzles 6.

The spindle 102 has an axial channel 104 starting from the end at the inlet 2 and via branchings 85 ending into an annular chamber 106 between the wall of the channel 3 and the opposite end part 107 of the spindle 102, said end part 107 being inserted into the ampoule holder 100 in sealed relation thereto. Towards the inlet end of the spindle 102, the annular chamber 106 ends in a plunger portion 88 sealed in relation to the wall of the channel 3. The annular surface 109 formed by the plunger 108 is equal to that surface of the inlet end of the spindle 102 which is under the influence of the liquid pressure acting in the inlet 2. The liquid pressure in the inlet 2 is thus balanced by the annular surface 109. Therefore, the spray head can be subjected to very high pressures in the inlet 2, including pressure shocks, without breaking the ampoule 101. A spray head as shown in FIG. 15 can be used to govern the activation of a plurality of other spray heads according to any of FIGS. 1–14.

I claim:

1. A nozzle for a spray head, the nozzle comprising:

housing (7; 61) having an orifice (13; 34);

a helical spring (20, 35; 63) in the housing and extending toward the orifice for liquid in the housing to flow in a helical path (23; 36; 70) between loops of the spring in a strong whirling motion before being discharged through the orifice; and a spindle element (17; 32, 37, 69) in an at least essentially cylindrical passage in the housing with the helical spring, the helical spring extending around the spindle element and engaging at one end the housing at the orifice and at an opposite end the spindle element for a force of the helical spring to urge the spindle element away from the orifice towards a stop (14) in the cylindrical passage, the spindle element being axially movable in an axial direction of the cylindrical passage in response to the force and an opposite-acting pressure force of the liquid.

2. The nozzle according to claim 1, characterized in that the opposite end of the helical spring bears against a flange (21) of the spindle element (17), the flange (21) having a diameter smaller than a diameter of the cylindrical passage to provide an annular passage (22) between the flange and a wall (9) of the cylindrical passage for creating a liquid pressure drop that creates the pressure force.

3. The nozzle according to claim 2, characterized in that said spindle element has a tapered extension (26; 38) forming an annular passage (27; 39) with the surrounding housing.

4. Nozzle according to claim 3, characterized in that said tapered extension (26) is arranged to block the feed channel (5) at a predeterminable liquid pressure.

5. The nozzle according to claim 2, characterized in that the movement of said spindle element (17) against the force of the spring (20) is restricted by the wall of a conical whirl chamber (12).

6. The nozzle according to claim 5, characterized in that the spindle contacts the whirl chamber wall by means of an end surface (18; 17) which has a number of oblique grooves (19; 74) to provide a passage between the abutting surfaces of the whirl chamber wall and the spindle element end surface (18).

7. The nozzle according to claim 5, characterized in that the spindle element fits sealingly against the whirl chamber wall by means of an end surface (18; 73).

8. The nozzle according to claim 1, characterized in that the helical spring (63) at its opposite end bears against a plunger-like portion (64) of the spindle element that the movement of the spindle element is in its one end position restricted by a stop at the inlet (2) of the spray head and in its other end position restricted by the nozzle housing (61) adjacent the nozzle orifice, and there is an annular passage (71) between said plunger-like portion (64) and the surrounding wall of the channel (3), said passage (71) being in connection to said helical path (70).

9. The nozzle according to claim 8, characterized in that the spindle element fits sealingly against the whirl chamber wall by means of an end surface (18; 73).

10. The nozzle according to claim 8, characterized in that movement of the spindle element (69) in its other end position is restricted against the wall of a conical whirl chamber (62) formed in said nozzle housing (61).

11. The nozzle according to claim 8, characterized in that the plunger-like portion (64) has an axial channel (65) providing for a connection between the spray head inlet (2) and the helical path (70).

12. The nozzle according to claim 11, characterized in that the axial channel (65) has a throttled inlet (66).

13. The nozzle according to claim 8, characterized in that the spindle contacts the whirl chamber wall by means of an end surface (18; 17) which has a number of oblique grooves (19; 74) to provide a passage between the abutting surfaces of the whirl chamber wall and the spindle element end surface (18).

* * * * *